US008081887B2

(12) United States Patent
Korfanta

(10) Patent No.: US 8,081,887 B2
(45) Date of Patent: Dec. 20, 2011

(54) SELECTIVE PRINT JOB AGGREGATION

(75) Inventor: Craig Korfanta, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 371 days.

(21) Appl. No.: 12/434,943

(22) Filed: May 4, 2009

(65) Prior Publication Data

US 2010/0278546 A1 Nov. 4, 2010

(51) Int. Cl.
*G03G 15/06* (2006.01)

(52) U.S. Cl. ..... 399/24; 399/25; 399/26; 399/111; 399/119; 399/262

(58) Field of Classification Search ..... 399/24–27, 399/79, 81, 111, 119, 262; 358/1.15
See application file for complete search history.

(56) References Cited

U.S. PATENT DOCUMENTS 4,538,896 A * 9/1985 Tajima et al. ..... 399/102
4,974,020 A * 11/1990 Takamatsu et al. ..... 399/12
5,678,125 A * 10/1997 Kutsuwada et al. ..... 399/26
5,742,882 A * 4/1998 Lee ..... 399/258
5,815,767 A * 9/1998 Kutsuwada et al. ..... 399/25
6,195,174 B1 2/2001 Johnson et al.
6,762,851 B1 7/2004 Lynch et al.
6,976,798 B2 12/2005 Keane et al.
7,102,773 B1 9/2006 Oosterhout et al.
2004/0158654 A1* 8/2004 Shima ..... 710/8
2006/0139678 A1 6/2006 Klopsch et al.
2007/0147854 A1* 6/2007 Yamada ..... 399/12
2008/0240826 A1 10/2008 Shen
2008/0291486 A1 11/2008 Isles et al.

* cited by examiner

*Primary Examiner* — David Gray
*Assistant Examiner* — G. M. Hyder
(74) *Attorney, Agent, or Firm* — Jack H. McKinney

(57) ABSTRACT

A selective job aggregation method includes identifying a predetermined usage match between a first consumable component and a second consumable component of printer device. Print jobs are then selectively aggregated to encourage expiration of a first expected useful life of the first consumable component to occur with expiration of a second expected useful life of the second consumable component.

20 Claims, 5 Drawing Sheets

SELECTIVE PRINT JOB AGGREGATION

BACKGROUND

Printing devices utilize consumable components. Those components can be supplied in a replaceable cartridge. A given cartridge, for example, can supply a first consumable component in the form of imaging material and a second consumable component in the form of an element used in transferring the imaging material to a print medium. Where the printing device is a laser printer, the imagining material could be toner while the element could be a drum and/or a seal. The cartridge stops functioning as desired when either one of the consumable components reaches the end of its useful life, that is, when the toner is depleted or when the drum/seal fails. When the drum or seal reaches its end of life first, a user can often detect the remaining toner. Even though the drum may have performed as designed, a user may be left with the false impression that, simply because toner remains, the cartridge should continue to provide quality results. Thus, consumer experience can be improved when the toner is depleted at the same time or before the drum reaches the end of its useful life.

DRAWINGS

DESCRIPTION

Introduction: Printing devices often utilize multiple consumable components. Various embodiments described below encourage expiration of an expected useful life of a first consumable component to occur with expiration of an expected useful life of a second consumable component. Where the printing device is a laser printer, various embodiments operate to time toner depletion with the expiration of the drum (or corresponding seal) responsible for transferring the toner to a print medium.

Manufacturers make assumptions to predict the lifespan of a consumable component for a printing device. Take a laser printer for example; such assumptions include an average amount of toner consumed per page printed and the average number of pages per print job delivered to the printer device. A toner cartridge sometimes reaches its end-of-life before the toner is depleted. This can be due to the drum, seal or other component reaching its end-of-life. Most often this is caused by the drum rotating more per output page than anticipated. Drum and seal life is measured by a number of drum rotations since the seal wears against the drum. Even though the drum may have performed as designed, a user may be left with the false impression that, simply because toner remains, the cartridge should continue to provide quality results. Thus, the consumer is left with a less than optimal experience.

Roughly speaking, the number of drum rotations is dependent upon job length (number of pages in a job) and the length of the media (e.g. paper) path. Using the example of a one page job, a thirty-three inch paper path and a three inch circumference drum, the drum will rotate at least eleven times to complete the job. Each additional page added to the job will add a number of rotations equal to the sum of the length of the page plus the inter-page gap divided by the circumference of the drum. Assuming an eleven inch page and one inch gap between pages, each additional page would add four rotations to the drum. With this understanding in mind, cartridge life yields are rated using an average job length across many environments and not necessarily an average specific to a particular consumer. In terms of pages, printing at jobs of greater lengths can extend cartridge life while printing jobs of lesser lengths can shorten cartridge life.

Figure 1:
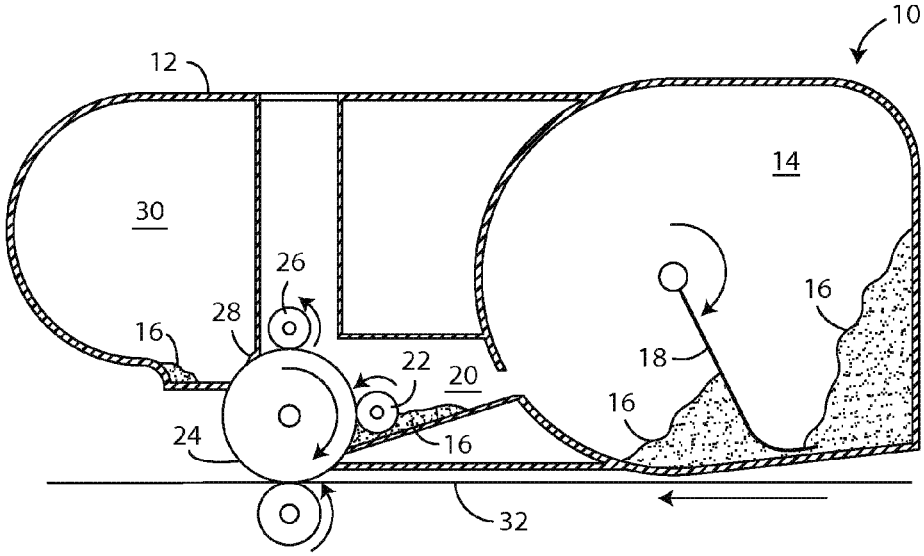
FIG. 1 is a schematic side view of a toner cartridge.
Figure 2:
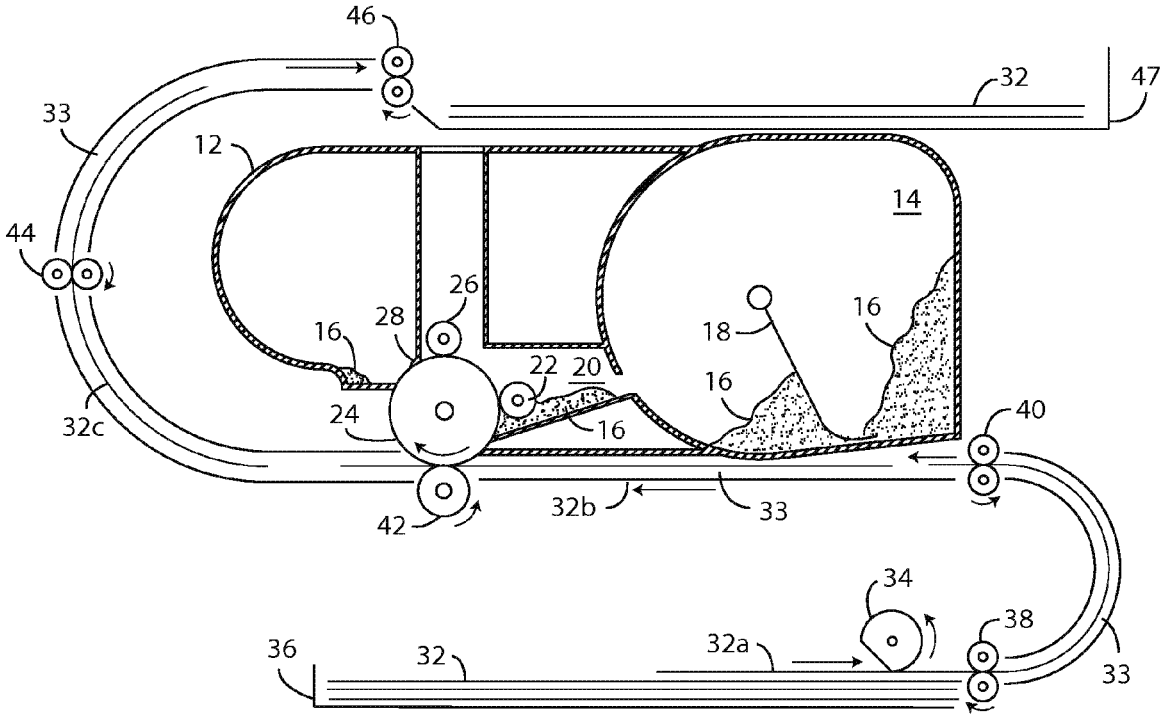
FIG. 2 is a schematic side view of a toner cartridge positioned along a media path.

FIGS. 1 and 2 help illustrate. FIG. 1 depicts an exemplary toner cartridge 10 configured to be inserted into a printing device. Cartridge 10 includes housing 12 that defines reservoir 14, imaging material in the form of toner 16, agitator 18, hopper 20, application roller 22, photoconductive drum 24, charge roller 26, wiper 28, and waste storage area 30. Reservoir 14 represents a cavity for holding a supply of toner 16. Agitator 18 is shown as a paddle that rotates, at the urging of an imaging device, within reservoir 14 to stir or "fluff" toner 16. During a printing process, toner 16 egresses reservoir 14 to hopper 20. Application roller 22 applies toner 16 from hopper 20 to photoconductive drum 24 which has been charged by charge roller 26. Wiper 26 removes residual toner from photoconductive drum 24. The residual toner is held in waste storage area 30.

In operation, light from a laser (not shown) is scanned across charged photoconductive drum 24 in a pattern of a desired print image. Where exposed to the light, photoconductive drum 24 is discharged creating an electrostatic version of the desired print image. Application roller 22 transfers toner particles to photoconductive drum 24. The toner particles are repelled by the charged portions of photoconductive drum 24 but adhere to the discharged portions. As media sheet 32 passes across photoconductive drum 24 toner particles are then transferred from photoconductive drum 24 to media sheet 32. Fuser rollers (not shown) supplied by the printer device, thermally fix the transferred toner particles to media sheet 32.

FIG. 2 depicts toner cartridge 10 in relation to an exemplary media path 33. Media path 33 represents generally a channel though which a media sheet 32 travels passed drum 24, In the example of FIG. 2, a pick roller 34 draws and feeds media sheet 32from input tray 36 to feed rollers 38 and 40. Drive roller 42 engages drum 24 and, when rotated, pulls media sheet 32*b* through media path 33 while diving drum 24. Drive rollers 44 urge media sheet 32*c* along path 33 while output rolled 46 are prepared to expel media sheet 32*c* into output bin 47.

In the example of FIG. 2, a print job of three sheets 32*a*-32*c* fills media path 33. Often, however, a print job may use only a single sheet underutilizing media path 33. In either case, drum 24 is continually rotated from the time a given media sheet 32 is drawn from input tray 36 and expelled into output bin 48. The expected life of cartridge is a function of a number of drum rotations and an amount of available toner 16. The toner level supplied in a cartridge is selected with the presumption that, on average, a user will generate print jobs of a predetermined number of uniformly sized pages. That predetermined number of pages is selected so that the expected useful lives of drum 24 and toner 16 are timed to expire at or about the same time. Should an actual average number pages per print job processed by cartridge 10 fall below the predetermined average, the expected life of drum 24 will expire before toner 16 is depleted. Should the actual average exceed the predetermined average, toner 16 will be depleted first. Taking steps to ensure that the actual average number equals or exceeds the predetermined average can help to extend the actual life of cartridge 10 in terms of printed pages.

Figure 3:
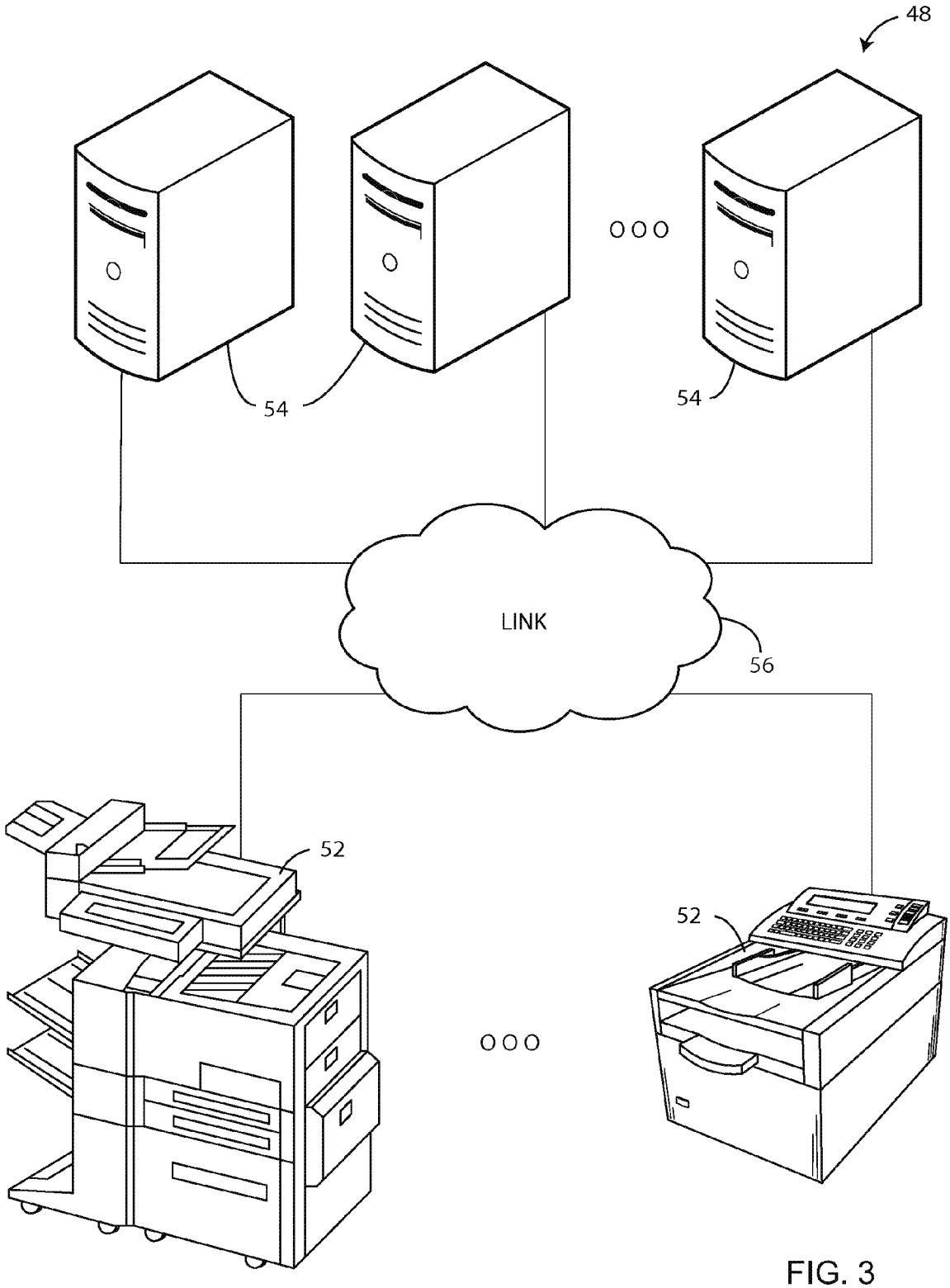
FIG. 3 is an exemplary block diagram of an environment in which various embodiments may be implemented.
Figure 4:
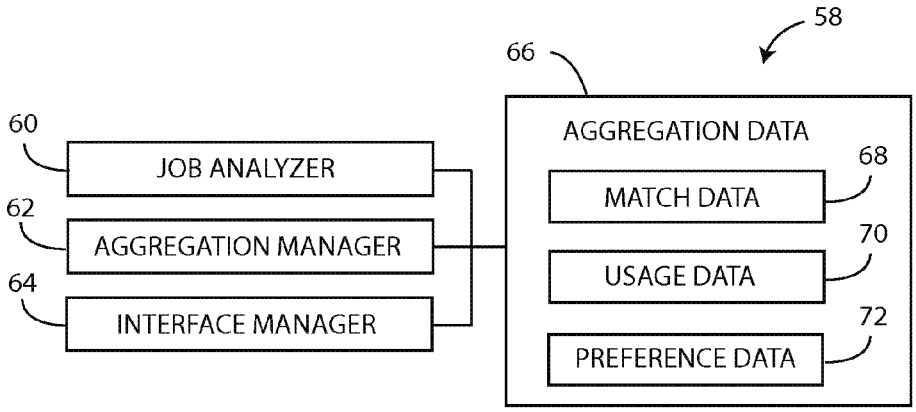
FIG. 4 is an exemplary block diagram of a selective job aggregator according to an embodiment.
Figure 5:
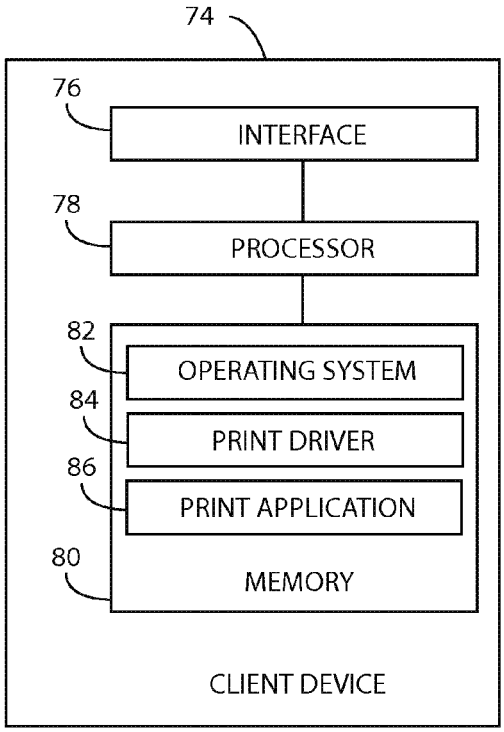
FIG. 5 is an exemplary block diagram of a client device according to an embodiment.
Figure 6:
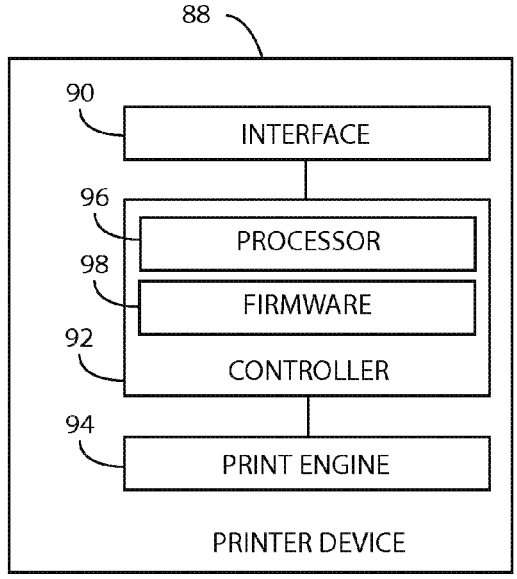
FIG. 6 is an exemplary block diagram of a printer device according to an embodiment.

Environment: FIG. 3 depicts an exemplary environment 48 in which various embodiments may be implemented. Environment 48 is shown to include printer devices 52 and client devices 56 connected via link 56. Printer devices 52 each represent generally any peripheral device configured to utilize two or more consumable components to produce printed images. Such consumable components may include but are not limited to imaging material such as toner and an element used in transferring the imaging material to a print medium. An exemplary element may be a drum and/or a seal. Client devices 54 represent generally any computing devices capable of communicating print jobs to printing devices 52. FIGS. 4-6, discussed below, illustrate various physical and logical components of a client device 54 and a printer device 52.

In the example of FIG. 3, link 56 interconnects client devices 54 and printer devices 52. Link 56 represents generally one or more of a cable, wireless, fiber optic, or remote connection via a telecommunication link, an infrared link, a radio frequency link, or any other connector or system that provides electronic communication.

Components: FIGS. 4-6 depict various physical and logical components that function as a job aggregator 58 according to various embodiments. Job aggregator 58 represents generally any combination of hardware and programming capable of selectively aggregating print jobs according to a predetermined usage match. The jobs are aggregated to encourage expiration of a first expected useful life of a first consumable component to occur with expiration of a second expected useful life of a second consumable component. The predetermined usage match represents generally any data that at least indirectly identifies a predicted usage level of at least one of the two consumable components. That predicted usage level is selected such that if it matches an actual usage level, the two consumable components are predicted reach the end of their expected useful lives at or about the same time. Take toner cartridge 10 of FIGS. 1 and 2 as an example. The predetermined usage match may be a predetermined number of pages per print job selected such that if it matches an actual average number of pages per print job, the drum and or seal will reach the end of its expected useful life at the same time as the toner.

Starting with FIG. 4, job aggregator 58 is shown to include job analyzer 60, aggregation manager 62, interface manager 64, and aggregation data 66. Job analyzer 60 represents generally any combination of hardware and programming configured to examine and report characteristics of print jobs. In a given implementation job analyzer 60 is responsible for identifying a number of pages in each given print job and to maintain an average number of pages for print jobs processed utilizing a given consumable component of a printer device.

Aggregation manager 62 represents generally any combination of hardware and programming configured to selectively aggregate print jobs to be processed by a consumable component of a printer device. The term aggregate is used to refer to holding print job until it can be released with one or more additional print jobs. To the printer device, the released aggregate appears as one larger print job. In performing its tasks, aggregation manager 62 may determine whether or not to hold a given print job to be aggregated based upon characteristics reported by job analyzer 60 and information read from aggregation data 66.

Figure 7:
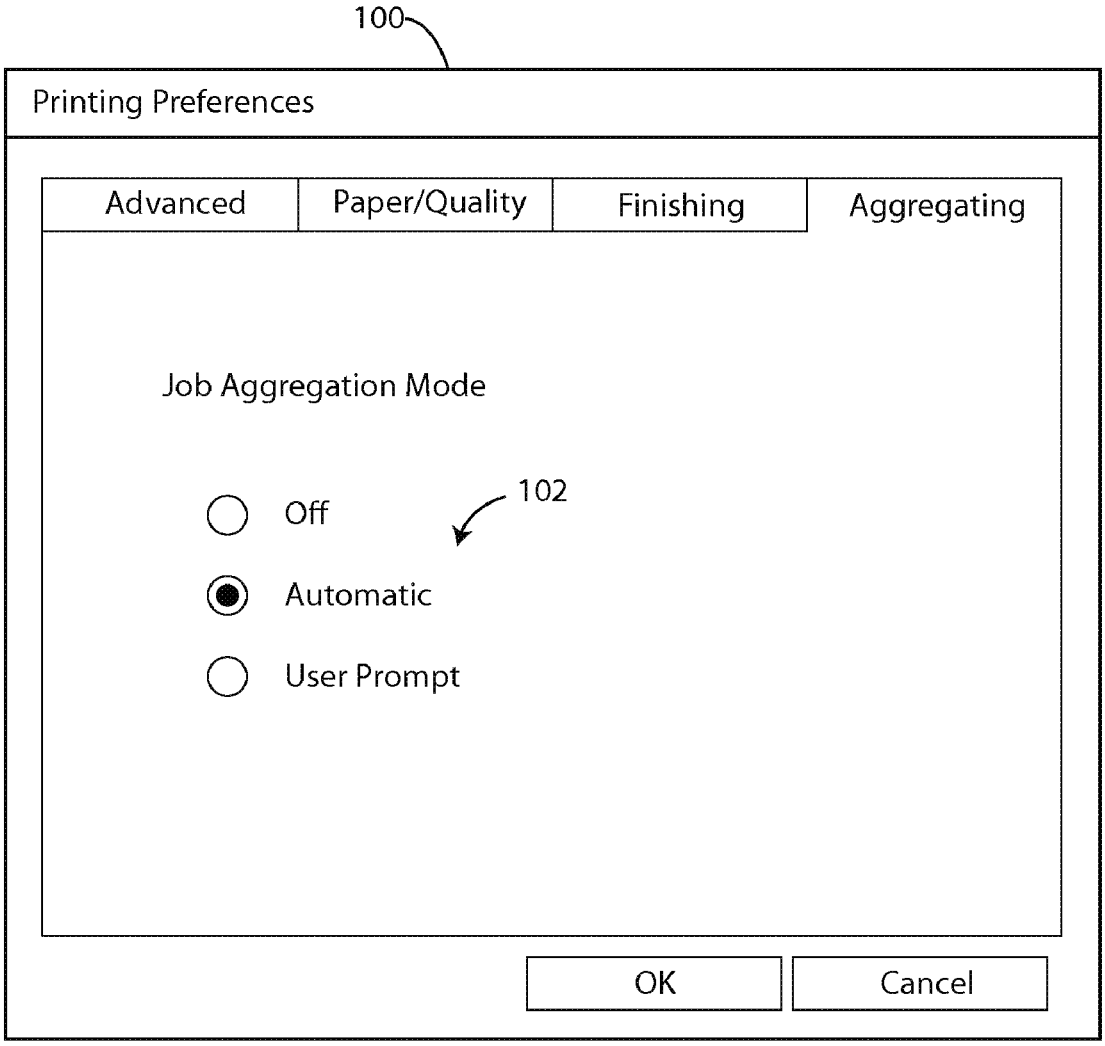
FIG. 7 is an exemplary screen view of a user interface having controls to enabling an aggregation feature according to an embodiment.
Figure 8:
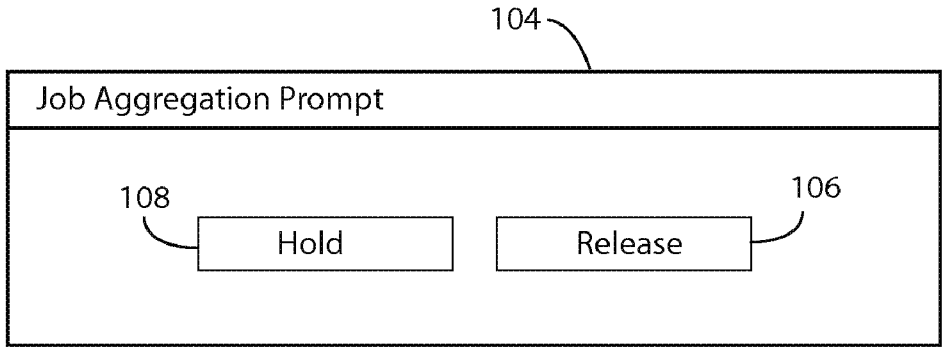
FIG. 8 is an exemplary screen view of a user interface having controls to manually release a held print job according to an embodiment.

Interface manager 64 represents generally any combination of hardware and programming configured to provide a user interface having controls enabling a user to interact with job aggregator 58. Examples of such user interfaces are depicted in FIGS. 7 and 8. An exemplary user interface may include controls for enabling and disabling job aggregator 58. Another user interface may include controls allowing a user to override job aggregator 58 and release a held print job.

Aggregation data 66 is shown to include match data 68, usage data 70, and preference data 72. Match data 68 represents the predetermined usage match for two consumable components of a printer device. As noted above, such may include a predetermined number of pages per print job. Usage data 70 represents data recorded by job analyzer 60 concerning actual usage statistics of a printer device. For example, usage data may indicate an average number of pages per print job processed by a consumable component of the printer device. Preference data 72 represents data indicating a user's selection enabling or disabling job aggregator 58.

In a particular example, job analyzer 60 examines a print job prepared for a printer device reporting characteristics of that print job such as a number of pages. Match data 68 may indicate a predetermined usage match in the form of a predetermined number of pages per print job. Aggregation manager 62 can then compare the number of pages in the print job as reported by job analyzer 60 with the predetermined number of pages indicated by match data 68. If the actual number is less than the predetermined number, aggregation manger 62 holds the print job to be aggregated with a subsequent print job and released as an aggregate print job. Such presumes that job aggregator 58 is enabled as indicated by preference data 72. If the actual number of pages exceeds the predetermined number, aggregation manager 62 takes no further action releasing the print job to be processed without regard to a subsequent print job.

Later, when the print job is merged with the subsequent print job forming an aggregate print job, aggregation manger 62 compares the actual number of pages in the aggregate print job with the predetermined number. If the actual number is less than the predetermined number, aggregation manger 62 holds the aggregate print job to be aggregated with another subsequent print job. If the actual number of pages exceeds the predetermined number, aggregation manager 62 takes no further action releasing the aggregate print job to be processed. This can repeat until an iteration of the aggregate print job is of sufficient size.

As noted above, job analyzer 60 may maintain an average number of pages for print jobs processed utilizing a given consumable component of the printer device. In such a case, aggregation manager 62 may be configured to hold and aggregate a print job if the predetermined number exceeds actual number of pages in that print job and the average number maintained by job analyzer 60.

In addition to actual number of pages, job analyzer 60 may also be configured to examine and report other characteristics of a print job. Such other characteristics may be indicative of a probability as to whether the print job is one a related batch of print jobs. In other words, job analyzer 60 is configured to determine a probability as to whether or not the print job will be followed by a subsequent print job within a given window of time. A user may generate a batch related documents at a one sitting. For example, a user, such as a lawyer or paralegal, rendering professional services often generates correspondence on behalf of a client. Three or more copies of the document may be produced: one original, one client copy and one file copy, along with two separate envelopes, one addressed to the party and one addressed to the client. Job analyzer 60 may be configured to recognize a likelihood that a print job is for an envelope leading to a likelihood that a subsequent print job for a letter will follow. Job analyzer 60 may be configured to recognize a likelihood that a print job is for a letter by recognizing an address field or a "cc" near the end of a page. Such can lead to a presumption that a subsequent print job for an envelope or a copy of the letter will follow. Job analyzer 60 can then report that a print job is likely to be followed by a subsequent related print job. In response, aggregation manager 62 can hold and aggregate the print job with a subsequent print job.

Job aggregator 58 of FIG. 4 may be implemented in a number of fashions. Referring to FIG. 5, job aggregator 58 may be implemented on client device 74. Client device 74 is shown to include interface 76, processor 78, and memory 80. Memory 80 includes operating system 82, print driver 84, and print application 86. Interface 76 represents a display and an input device such as a keyboard and mouse. Processor 78 represents any processor configured to execute operating system 82, print driver 84, and print application 86 found in memory 80. Operating system 82, print driver 84, and print application 86 represent programming instructions that together allow a user to generate and generate a print job for an electronic document. Comparing FIGS. 4 and 5, aggregation data 66 may be data stored in memory 80. Job analyzer 60, aggregation manager 62, and interface manager 64 may be implemented as a combination of processor 78, memory 80, and corresponding program instructions found in one or more of operating system 82, print driver 84, and print application 86.

Referring to FIG. 6, job aggregator 58 may be implemented on printer device 88. Printer device 88 is shown to include interface 90, controller 92, and print engine 94. Controller 92 includes processor 96 and firmware 98. Interface 92 represents buttons and or a display. Processor 96 represents any processor configured to execute program instructions in firmware 98 to process a print job causing cause print engine 94 to produce one or more printed pages. Comparing FIGS. 4 and 6, aggregation data 66 may be data stored with firmware 98. Job analyzer 60, aggregation manager 62, and interface manager 64 may be implemented as a combination of processor 96 and corresponding program instructions found in firmware 98.

FIGS. 7 and 8 depict exemplary screen displays of user interfaces for interacting with job aggregator 58 of FIG. 4. Referring first to FIG. 7, user interface 100 includes user accessible controls 102 allowing a user to enable or disable job aggregator 58. Enabling, in this example, can include an "automatic" setting in which job aggregator 58 operates without user input or a "user prompt" setting in which user input is used. User interface 104 of FIG. 8 includes controls 106 and 108 for manually causing job aggregator 58 to release or hold a print job. Referring to FIGS. 5-8, user interface 104 may be displayed by client device 72 or printer device 88 when the "user prompt" setting is selected via user interface 100.

Figure 9:
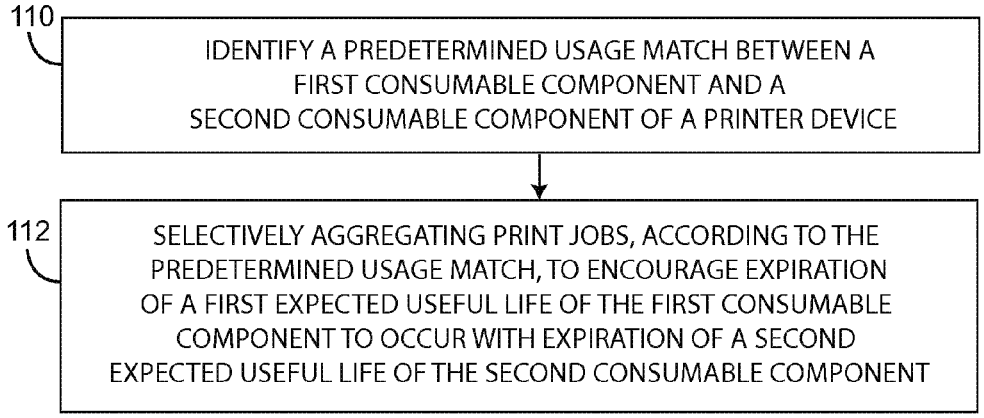
FIGS. 9-10 are exemplary flow diagrams depicting steps taken to implement various embodiments.
Figure 10:
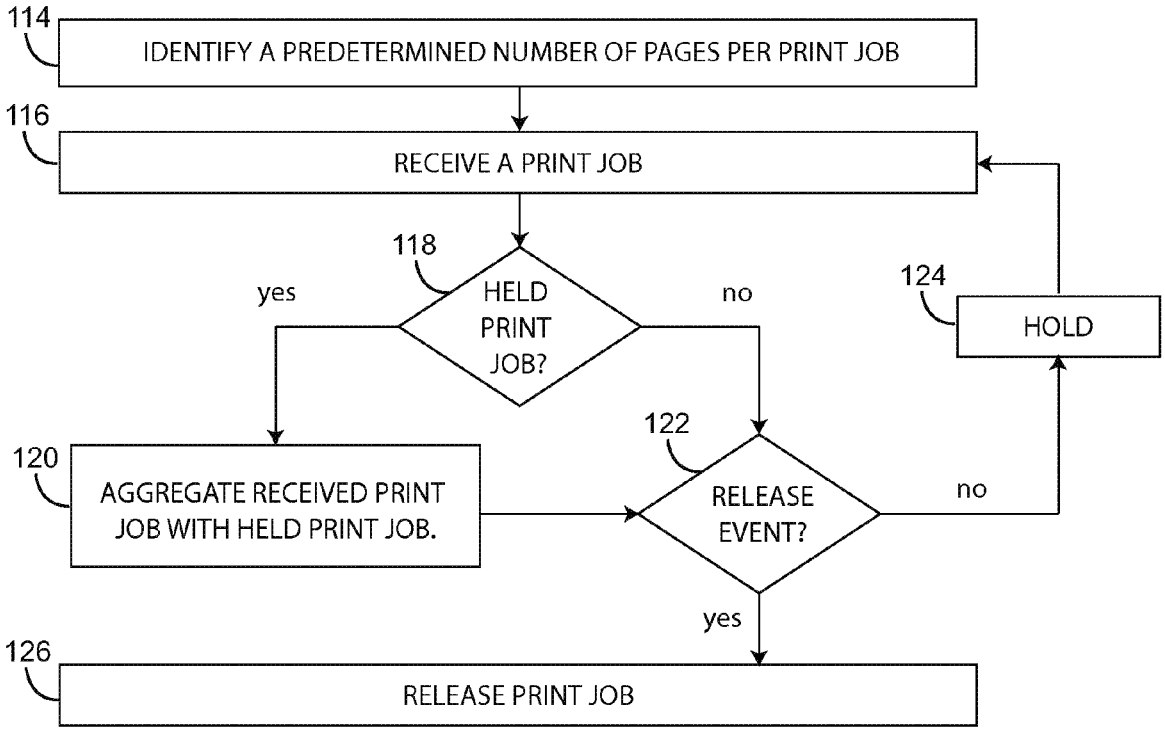

Operation: FIGS. 9 and 10 are exemplary flow diagrams depicting steps taken to implement various embodiments. In discussing FIGS. 9 and 10, reference is made to the diagrams of FIGS. 1-8 to provide contextual examples. Implementation, however, is not limited to those examples. Starting with FIG. 9, a predetermined usage match between a first consumable component and a second consumable component of printer device is identified (step 110). As discussed above, the predetermined usage match can be data that at least indirectly identifying a predicted usage level of at least one of the two consumable components. Referring to FIG. 4, aggregation manager 62 may acquire the predetermined usage match from aggregation data 68.

Where, for example, the consumable components are components of a toner cartridge such as cartridge 10, the predicated usage level may correspond to a predetermined number of pages per print job. That predetermined number of pages is selected to match an expected useful life of a toner supply with an expected useful life of an element such as a drum configured to transfer the toner to a print medium. The predetermined number of pages correlates to an average number of drum rotations and an average amount of toner consumption with respect to a print job.

Print jobs are then selectively aggregated according to the predetermined usage match (step 112). The jobs are selectively aggregated to encourage expiration of a first expected useful life of the first consumable component to occur with expiration of a second expected useful life of the second consumable component. In performing step 112, job analyzer 60 may report the actual number of pages in a print job. Comparing the actual number to the predetermined number identified in step 110, aggregation manager 62 can selectively determine whether or not to hold and aggregate the print job with a subsequent print job. For example, aggregation manager 62 may hold the print job if the actual number is less than the predetermined number and otherwise release the print job for printing without regard to a subsequent print job.

In another example, job analyzer 62 may maintain a running average of the number of pages per print job processed by one of the consumable components. Implementing step 112, aggregation manager 62 may then hold the print job if the actual and average numbers are less than the predetermined number. As previously discussed, job analyzer 60 may also be able to identify characteristics of a print job that indicate a probability that the print job is or will be part of a related batch of print jobs. In this case, aggregation manager 62 may implement step 112 if the predetermined number exceed the actual number of pages in the print job and the probability indicates a likelihood that the print job will be one of a related batch of print jobs.

Moving to FIG. 10, a predetermined number of pages per print job is identified (step 114). Referring to FIG. 4, aggregation manager 62 may acquire the predetermined number from aggregation data 68. A print job is received (step 116). It is determined if there a print job already being held to be aggregated (step 118). If no, the process skips to step 122. If yes, the print job received in step 116 is aggregated with the held print job creating an aggregate print job (step 120). It is determined if a release event has occurred (step 122). If yes the print job is released to be printed (step 126). The released print job may be an aggregate print job if step 120 was performed. If no, the print job or aggregate print job is held to be aggregated with a subsequent print job (step 124). The process repeats with step 116.

A release event in step 122 may, for example, be a determination that the actual number of pages in the print job or aggregate print job exceeds the predetermined number in step 114. The release event may, for example, be a determination that an average number of pages per print job processed using a consumable component of a printer device exceeds the predetermined number. In yet another example, a release event may be recognition of a user input indicating a desire to release a held print job.

Conclusion: The cartridge 10 shown in FIGS. 1 and 2 provides an example of consumable components. Implementation of various embodiments, however, is not limited to the consumable components of cartridge 10. Embodiments can be implemented with respect to in any consumable components for which it may be desirable to encourage a first expected useful life of the one consumable component to expire at the same time or before expiration of a second expected useful life of another consumable component. Certain components are defined at least in part as a program or program instructions. Such components may represent, at least in part, a module, segment, or portion of code that comprises one or more executable instructions to implement the specified logical function(s). Such components may also represent a circuit or a number of interconnected circuits to implement the specified logical function(s).

Also, the present invention can be embodied in any computer-readable media for use by or in connection with an instruction execution system such as a computer/processor based system or an ASIC (Application Specific Integrated Circuit) or other system that can fetch or obtain the logic from computer-readable media and execute the instructions contained therein. "Computer-readable media" can be any media that can contain, store, or maintain programs and data for use by or in connection with the instruction execution system. Computer readable media can comprise any one of many physical media such as, for example, electronic, magnetic, optical, electromagnetic, or semiconductor media. More specific examples of suitable computer-readable media include, but are not limited to, a hard drive, a random access memory (RAM), a read-only memory (ROM), an erasable programmable read-only memory, or a portable disc.

Although the flow diagrams of FIGS. 9-10 show specific orders of execution, the orders of execution may differ from that which is depicted. For example, the order of execution of two or more blocks may be scrambled relative to the order shown. Also, two or more blocks shown in succession may be executed concurrently or with partial concurrence. All such variations are within the scope of the present invention.

The present invention has been shown and described with reference to the foregoing exemplary embodiments. It is to be understood, however, that other forms, details and embodiments may be made without departing from the spirit and scope of the invention that is defined in the following claims.

What is claimed is:

1. A selective print job aggregation method, comprising:

identifying a predetermined usage match between a first consumable component of a replaceable cartridge for a printer device and a second consumable component of the cartridge; and selectively aggregating print jobs, according to the predetermined usage match, to encourage expiration of a first expected useful life of the first consumable component to occur with expiration of a second expected useful life of the second consumable component.

2. The method of claim 1,. wherein:

the first consumable component includes imaging material and the second consumable component includes an element used in transferring the imaging material to a print medium; and identifying comprises identifying a predetermined number of pages per print job, the predetermined number of pages selected to match the first expected useful life of the imaging material with the second expected useful life of the element configured to transfer the imaging material to the print medium.

3. The method of claim 2, wherein selectively aggregating comprises holding a first print job and aggregating the first print job with a subsequent print job to be released as an aggregated print job if the first print job is of fewer pages than the predetermined number and otherwise individually releasing the first print job for printing without regard to the subsequent print job.

4. The method of claim 3, wherein the subsequent print job is a first subsequent print job and the aggregated print job is a first aggregated print job, the method further comprising, if the first print job is aggregated with the first subsequent print job, holding the first aggregate print job to be aggregated with a second subsequent print job to be released as a second aggregated print job if the first aggregate print job is of fewer pages than the predetermined number and otherwise individually releasing the first aggregate print job for printing without regard to the second subsequent print job.

5. The method of claim 2, wherein selectively aggregating comprises:

examining characteristics of a first print job to determine a probability that the first print job will be one of a related batch of print jobs; and holding the first print job to be aggregated with a subsequent print job to be released as an aggregated print job if the predetermined number exceeds a number of pages in the first print job and the probability indicates a likelihood that the first print job will be one of a related batch of print jobs.

6. The method of claim 2, wherein selectively aggregating comprises:

detecting an actual printer usage level corresponding to an average number of pages per print job; and holding a first print job to be aggregated with a subsequent print job to be released as an aggregated print job if the predetermined number exceeds both a number of pages in the first print job and the average number of pages per print job and otherwise individually releasing the first print job for printing without regard to the subsequent print job.

7. A non-transitory computer readable medium having computer executable instructions stored thereon, the execution of which implements a method, the method comprising:

identifying a predetermined usage match between a first consumable component of a replaceable cartridge for a printer device and a second consumable component of the cartridge; and selectively aggregating print jobs, according to the predetermined usage match, to encourage expiration of a first expected useful life of the first consumable component to occur with expiration of a second expected useful life of the second consumable component.

8. The computer readable medium of claim 7, wherein:

the first consumable component includes imaging material and the second consumable component includes an element used in transferring the imaging material to a print medium; and identifying comprises identifying a predetermined number of pages per print job, the predetermined number of pages selected to match the first expected useful life of the imaging material, with the second expected useful life of the element configured to transfer the imaging material to the print medium.

9. The computer readable medium claim 8, wherein selectively aggregating comprises holding a first print job and aggregating the first print job with a subsequent print job to be released as an aggregated print job if a first print job is of fewer pages than the predetermined number and otherwise individually releasing the first print job for printing without regard to the subsequent print job.

10. The computer readable medium claim 9, wherein the subsequent print job is a first subsequent print job and the aggregate print job is a first aggregate print job, the medium having instructions stored thereon, the execution of which implements a method that includes, if the first print job is held, holding the first aggregate print job to be aggregated with a second subsequent print job to be released as a second aggregated print job if the first aggregate print job is of fewer pages than the predetermined number and otherwise individually releasing the first aggregate print job for printing without regard to the second subsequent print job.

11. The computer readable medium of claim 9 having instructions stored thereon, the execution of which implements a method that includes providing for a display of a user interface having user accessible controls for enabling and disabling a job aggregation feature, and wherein holding comprises holding the first print job to be aggregated with a subsequent print job to be released as an aggregated print job if a first print job is of fewer pages than the predetermined number and the job aggregation feature has been enabled via the user interface and otherwise individually releasing the first print job for printing without regard to the subsequent print job.

12. The computer readable medium of claim 9 having instructions stored thereon, the execution of which implements a method that includes providing for a display of a user interface having a user accessible control for releasing a held print job and wherein holding comprises holding the first print job to be aggregated with a subsequent print job to be released as an aggregated print job if a first print job is of fewer pages than the predetermined number so long as the user accessible control has not been selected and otherwise individually releasing the first print job for printing without regard to the subsequent print job.

13. The computer readable medium of claim 8, therein selectively aggregating comprises:

examining characteristics of a first print job to determine a probability that the first print job will be one of a related batch of print jobs; and holding the first print job to be aggregated with a subsequent print job to be released as an aggregated print job if the predetermined number exceeds a number of pages in the first print job and the probability indicates a likelihood that the first print job will be one of a related batch of print jobs.

14. The computer readable medium of claim 8, wherein selectively aggregating comprises:

detecting an actual printer usage level corresponding to an average number of pages per print job; and holding a first print job to be aggregated with a subsequent print job to be released as an aggregated print job if the predetermined number exceeds both a number of pages in a first print job and the average number of pages per print job and otherwise individually releasing the first print job for printing without regard to the subsequent print job.

15. A system for selectively aggregating print jobs, the system including an aggregation manager, the aggregation manager being configured to:

identify a predetermined usage match between a first consumable component of a replaceable cartridge for a printer device and a second consumable component of the cartridge; and selectively aggregate print jobs, according to the predetermined usage match, to encourage expiration of a first expected useful life of the first consumable component to occur with expiration of a second expected useful life of the second consumable component.

16. The system of claim 15, wherein:

the first consumable component includes imaging material and the second consumable component includes an element used in transferring the imaging material to a print medium; and the aggregation manager is configured to identify a predetermined usage match by identifying a predetermined number of pages per print job, the predetermined number of pages selected to match the first expected useful life of the imaging material with the second expected useful life of the element configured to transfer the imaging material to the print medium.

17. The system of claim 16, wherein the aggregation manager is configured to selectively aggregate by holding a first print job and aggregating the first print job with a subsequent print job to be released as an aggregated print job if the first print job is of fewer pages than the predetermined number and otherwise individually releasing the first print job fur printing without regard to the subsequent print job.

18. The system of claim 17, wherein the subsequent print job is a first subsequent print job and the aggregated print job is a first aggregated print job, the aggregation manager being configured to, if the first print job is aggregated with the first subsequent print job, hold the first aggregate print job to be aggregated with a second subsequent print job to be released as a second aggregated print job if the first aggregate print job is of fewer pages than the predetermined number and otherwise individually release the first aggregate print job for printing without regard to the second subsequent print job.

19. The system of claim 16:

further comprising a job analyzer configured to examine characteristics of a first print job to determine a probability that the first print job will be one of a related batch of print jobs; and wherein the aggregation manager is configured to hold the first print job to be aggregated with a subsequent print job to be released as an aggregated print job if the predetermined number exceeds a number of pages in the first print job and the probability indicates a likelihood that the first print job will be one of a related batch of print jobs and otherwise release the print job without regard to the subsequent print job.

20. The system of claim 16:

further comprising a job analyzer configured to detect an actual printer usage level corresponding to an average number of pages per print job; and wherein the aggregation manager is configured to hold the first print job to be aggregated with a subsequent print job to be released as an aggregated print job if the predetermined number exceeds both a number of pages in the first print job and the average number of pages per print job and otherwise release the print job without regard to the subsequent print job.

* * * * *

UNITED STATES PATENT AND TRADEMARK OFFICE

CERTIFICATE OF CORRECTION

PATENT NO. : 8,081,887 B2
APPLICATION NO. : 12/434943
DATED : December 20, 2011
INVENTOR(S) : Craig Korfanta It is certified that error appears in the above-identified patent and that said Letters Patent is hereby corrected as shown below:

In column 7, line 57, in Claim 2, delete “claim 1,.” and insert -- claim 1, --, therefor.

In column 8, line 60, in Claim 8, delete “material,” and insert -- material --, therefor.

In column 8, line 63, in Claim 9, delete “medium claim” and insert -- medium of claim --, therefor.

In column 9, line 3, in Claim 10, delete “medium claim” and insert -- medium of claim --, therefor.

In column 9, line 38, in Claim 13, delete “therein” and insert -- wherein --, therefor.

In column 10, line 26, in Claim 17, delete “fur” and insert -- for --, therefor.

Signed and Sealed this
First Day of January, 2013

David J. Kappos

David J. Kappos
*Director of the United States Patent and Trademark Office*